US008366421B2

(12) United States Patent
Munakata et al.

(10) Patent No.: US 8,366,421 B2
(45) Date of Patent: Feb. 5, 2013

(54) FLUID PRESSURE PULSATION DAMPER MECHANISM AND HIGH-PRESSURE FUEL PUMP EQUIPPED WITH FLUID PRESSURE PULSATION DAMPER MECHANISM

(75) Inventors: Akihiro Munakata, Hitachinaka (JP); Hideki Machimura, Tokai (JP); Hideaki Yamauchi, Hitachinaka (JP); Daisuke Kitajima, Hitachinaka (JP); Masashi Nemoto, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 996 days.

(21) Appl. No.: 12/124,084

(22) Filed: May 20, 2008

(65) Prior Publication Data

US 2008/0289713 A1 Nov. 27, 2008

(30) Foreign Application Priority Data

May 21, 2007 (JP) ..... 2007-133612

(51) Int. Cl.
*F04B 11/00* (2006.01)
*F02M 37/00* (2006.01)

(52) U.S. Cl. ..... 417/540; 123/510

(58) Field of Classification Search ..... 123/446, 123/447, 510; 417/540, 543
See application file for complete search history.

(56) References Cited

U.S. PATENT DOCUMENTS

| | | | | |
|---|---|---|---|---|
| 4,507,063 | A * | 3/1985 | Kemmner et al. | 417/540 |
| 5,794,594 | A * | 8/1998 | Fehlmann | 123/450 |
| 6,062,830 | A * | 5/2000 | Kikuchi et al. | 417/540 |
| 6,095,774 | A * | 8/2000 | Tanaka et al. | 417/540 |
| 6,135,734 | A * | 10/2000 | Isozumi et al. | 417/542 |
| 6,223,725 | B1 * | 5/2001 | Onishi et al. | 123/447 |
| 7,124,738 | B2 * | 10/2006 | Usui et al. | 123/446 |
| 7,165,534 | B2 * | 1/2007 | Usui et al. | 123/467 |
| 2003/0164161 | A1 * | 9/2003 | Usui et al. | 123/510 |

FOREIGN PATENT DOCUMENTS

| | | | |
|---|---|---|---|
| DE | 10 2004 002 489 | A1 | 8/2005 |
| EP | 1 411 236 | A2 | 4/2004 |
| JP | 2003-254191 | A | 9/2003 |
| JP | 2004-138071 | A | 5/2004 |
| JP | 2005-42554 | A | 2/2005 |
| JP | 2006-521487 | A | 9/2006 |
| WO | WO 2005/031161 | A2 | 4/2005 |

OTHER PUBLICATIONS

Corresponding European Search Report dated Sep. 7, 2009 (Eight (8) pages).

* cited by examiner

*Primary Examiner* — Charles Freay
*Assistant Examiner* — Alexander Comley
(74) *Attorney, Agent, or Firm* — Crowell & Moring LLP

(57) ABSTRACT

A fluid pressure pulsation damper mechanism includes: a metal damper having two metal diaphragms joined together with a hermetic seal for forming a sealed spacing filled with a gas between the two metal diaphragms, an edge part overlapping along outer peripheries thereof, a main body having a damper housing in which the metal damper is accommodated, and a cover attached to the main body to cover the damper housing and isolate the damper housing from outside air.

18 Claims, 9 Drawing Sheets

FLUID PRESSURE PULSATION DAMPER MECHANISM AND HIGH-PRESSURE FUEL PUMP EQUIPPED WITH FLUID PRESSURE PULSATION DAMPER MECHANISM

CLAIM OF PRIORITY

The present application claims priority from Japanese application serial No. 2007-133612, filed on May 21, 2007, the content of which is hereby incorporated by reference into this application.

BACKGROUND OF THE INVENTION

1. Field of the Invention

The present invention relates to a fluid pressure pulsation damper mechanism, and more particularly to a fluid pressure pulsation damper mechanism in which a metal damper is disposed between a main body and a cover attached to the main body and thereby held, the metal damper being formed by joining two metal diaphragms and filling a gas between them.

The present invention also relates to a high-pressure fuel pump that is equipped with the above fluid pressure pulsation damper mechanism and used with an internal combustion engine.

2. Description of Related Art

With known conventional fluid pressure pulsation damper mechanisms of this type, two metal diaphragms are joined by being welded along their outer peripheries, a gas is filled between them to form a discal bulge, and a ring-shaped flat, plate part formed by overlapping the two metal diaphragms is disposed between the peripheral welded part and the discal bulge. Two outer surfaces of the flat plate part are held between the cover and a thick part of the main body. Alternatively, to hold the two outer surfaces, elastic bodies are disposed between the cover and ring-shaped flat plate part and between the main body and the ring-shaped flat plate part (see Japanese Patent Application Laid-open No. 2004-138071, Japanese Patent Application Laid-open No. 2006-521487, Japanese Patent Application Laid-open No. 2003-254191, and Japanese Patent Application Laid-open No. 2005-42554.)

Patent Document 1: Japanese Patent Application Laid-open No. 2004-138071

Patent Document 2: Japanese Patent Application Laid-open No. 2006-521487

Patent Document 3: Japanese Patent Application Laid-open No. 2003-254191

Patent Document 4: Japanese Patent Application Laid-open No. 2005-42554

SUMMARY OF THE INVENTION

The technology described above prior arts has a problem in that the cover is made of a thick material and thus increases the weight of the fluid pressure pulsation damper mechanism.

An object of the present invention is to reduce the weight of a fluid pressure pulsation damper mechanism or a high-pressure fuel pump equipped with a fluid pressure pulsation damper mechanism.

To achieve the above object, a fluid pressure pulsation damper mechanism according to the present invention comprising: a metal damper having two metal diaphragms joined together with a hermetic seal for forming a sealed spacing filled with a gas between the two metal diaphragms, an edge part at which are overlapped along outer peripheries thereof; a main body having a damper housing in which the metal damper is accommodated; and a cover attached to the main body to cover the damper housing and isolate the damper housing from an outside air, the metal damper being held between the cover and the main body; wherein the cover is further comprising: a metal plate for making the cover, a peripheral edge of the cover being joined to the main body, a plurality of inner convex curved parts extending toward the main body and a plurality of outer convex curved parts extending in a direction away from the main body, and a plurality of the inner convex curved parts and a plurality of the outer convex parts being disposed alternately inside the peripheral edge of the cover at which the cover is joined to the main body; wherein the cover is attached to the main body, ends of the plurality of inner convex curved parts touch one side of the edge part of the metal damper, which are outwardly formed in radial directions of a part including the sealed spacing in the metal damper; and the metal damper is held between the cover and a metal damper holding part of a holding member placed on the main body.

According to the present invention, the cover is made of a thin metal plate, but the inner convex curved parts have necessary stiffness. In addition, the outer convex curved parts form channels through which spacings inside and outside the metal diaphragm communicate with each other. Accordingly, the fluid pressure pulsation damper mechanism can be made lightweight.

DETAILED DESCRIPTION OF THE PREFERRED EMBODIMENTS

An object of an embodiment of the present invention is to reduce the weight of a fluid pressure pulsation damper mechanism or a high-pressure fuel pump equipped with a fluid pressure pulsation damper mechanism.

Accordingly, the damper cover in the embodiment of the present invention is made by pressing a thin metal plate.

When the damper cover is made of a thin metal plate, some problems arise; there is a fear that necessary stiffness is not obtained, it is difficult to configure a part for pressing the damper, and it is also difficult to configure channels through which the inside and outside of the damper communicate with each other.

In a fluid pressure pulsation damping mechanism in the embodiment of the present invention, inner convex curved parts and outer convex curved parts are alternately formed along the periphery of the cover. The cross sectional shape of a part between the inner convex curved part and outer convex curved part has a combined stiffness greater than the stiffness of the flat part. The thickness of the cover is substantially uniform over its entire area. The flat part has prescribed elasticity. The inner convex curved part has prescribed stiffness.

A part for pressing the metal diaphragms is formed on each inner convex curved part having the prescribed stiffness, and channels through which the inner periphery and outer periphery of the metal diaphragm pressing part communicate with each other are formed with the outer convex curved parts.

Accordingly, means for pressing the dumper and fluid communicating channels can be formed by the convex and concave parts disposed to obtain stiffness. The weight of the cover can thereby be reduced without losing necessary functions as the cover member of the metal damper mechanism.

A fluid pressure pulsation damping mechanism in embodiments of the present invention will be described in detail with reference to the drawings.

First Embodiment

Figure 12:
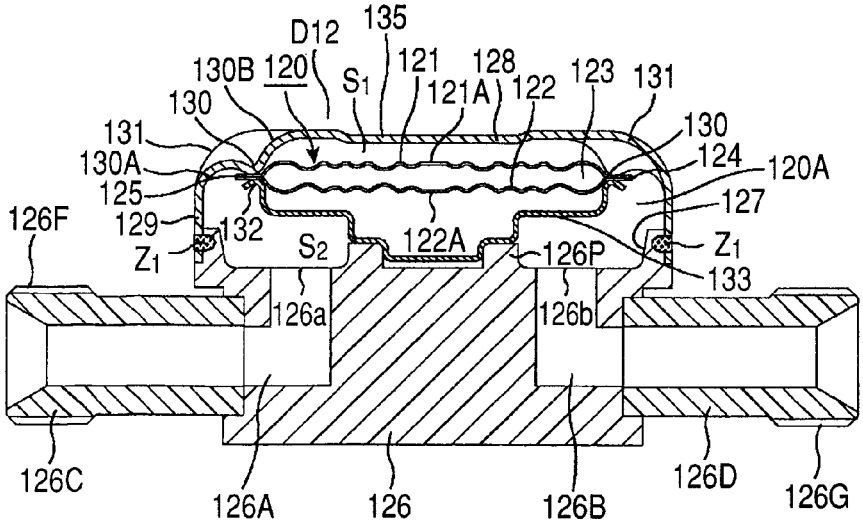
FIG. 12 is a longitudinal sectional view of a fluid pressure damper mechanism in a first embodiment of the present invention.

FIG. 12 is a longitudinal cross sectional view of a fluid pressure pulsation damping mechanism in a first embodiment of the present invention.

The metal damper 120 in the fluid pressure pulsation damping mechanism D12 comprises two metal diaphragms 121 and 122, between which there is a sealed spacing 123 filled with a gas.

An edge part 124 of the metal damper 120 is formed by overlapping the peripheries of the two metal diaphragms 121 and 122; welding is performed over the entire peripheries of the outer edge 125 of the edge part 124, maintaining a hermetic seal inside the sealed spacing 123.

A damper housing part 120A accommodates the metal damper 120, and its frame 127 is formed on the outer surface of a main body 126.

The frame 127 on the main body 126 is ring-shaped; the internal periphery of a skirt 129 of a cover 128 fits into the outer periphery of the frame 127 of the main body 126, and the damper housing part 120A is formed by welding their entire peripheries at Z1. The metal damper 120 internally disposed is covered with the cover 128 to isolate it from the outside air, and the metal damper 120 is held between the main body 126 and cover 128.

The cover 128, which is formed by pressing a thin metal plate having a uniform thickness, has inner convex curved parts 130 extending toward the main body 126 and outer convex curved parts 131 extending in a direction away from the main body 126; these convex curved parts are both inside the skirt 129 (the joint part along the peripheral edge) of the cover 128, are alternately formed. With the cover 128 attached to the main body 126, the end of each inner convex curved part 130 touches the surface of one side of the edge part 124 of the metal damper 120 (the upper surface in FIG. 12), which are outwardly formed in radial directions of a part including the sealed spacing in the metal damper 120; the edge part 124 being formed in a radial direction outside the sealed spacing formed in the metal damper 120. A metal damper holding part 132 facing the main body 126 touches the surface of the other side of the edge part 124 (the lower surface in FIG. 12). The metal damper 120 is held between the metal damper holding part 132 and inner convex curved parts 130.

The metal damper 120 is discal, and has bulges 121A and 122A, between which a sealed spacing is formed. The ring-shaped flat part 124 is formed along the peripheral edge part. The outer peripheral edges of the ring-shaped flat part 124 are joined by being welded at 125 over their entire peripheries. The ends of the inner convex curved parts 130 on the cover 128 touch the ring-shaped flat part 124, which is more inside than the welded part 125 along the outer peripheral edge part.

The end of the inner convex curved part 130 on the cover 128 is a flat part 130F (see FIG. 7), which is flattened by being pressurized during pressing. The flat part 130F is thereby placed in tight contact with the edge part 124 on the peripheral edge part of the metal damper 120, reducing uneven contact. Accordingly, a force for holding the metal damper 120 falls within a prescribed range even when any fluid pressure pulsation damping mechanism is used, and thus a high yield is obtained.

Figure 7:
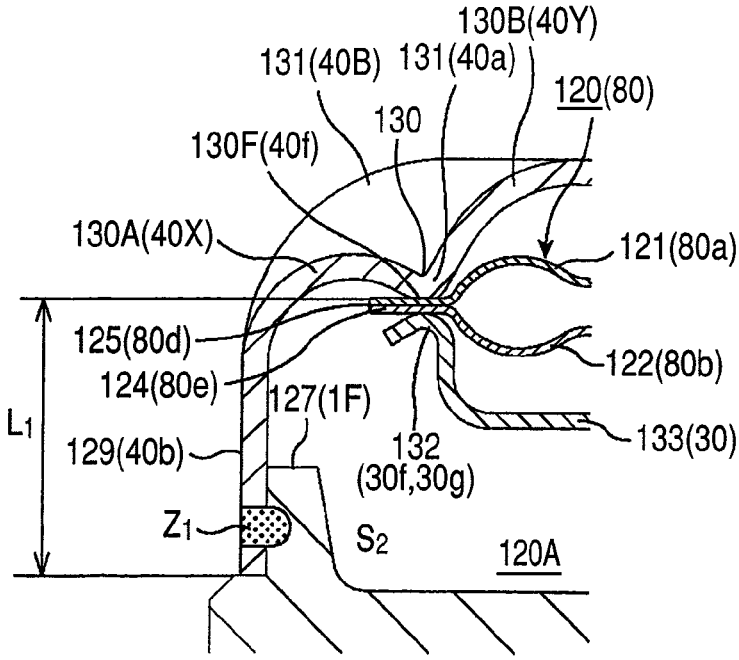
FIG. 7 is a partially enlarged view of the fluid pressure damper mechanism in the first embodiment and the fourth embodiment of the present invention.

As shown in FIG. 7, the metal damper 120 is placed on a cup-shaped holding member 133, and the cover 128 is placed thereon. The cover 128 is then pressed against the main body 126, and the skirt 129 and the frame 127 of the main body are welded at Z1 over the entire periphery. When the dimension between the bottom surface of the skirt 129 and the flat part 130F at the end of the inner convex curved part 130 is managed so that the dimension becomes prescribed dimension L1, variations in the dimension are eliminated and thus variations in holding force are also eliminated.

The cup-shaped holding member 133, which faces the main body 126, is provided separately from the main body 126, and set to a ring-shaped positioning protrusion 126P disposed at the center of the damper housing part 120A on the main body 126. A curled part 132 formed on the upper end of the holding member 133 supports the lower surface of the peripheral edge part 124 of the metal damper 120.

The holding member 133 is elastically deformed and adjusts its holding force when the inner convex curved parts 130 press the metal damper 120 toward the main body 126.

As shown in FIG. 12, a fluid inlet 126C, through which fluid is supplied to the damper housing part 120A, is attached to the main body 126. The fluid inlet 126C and a hole 126*a* formed in the damper housing part 120A communicate with each other through an inlet channel 126A formed in the main body 126. A fluid outlet 126D, through which fluid is expelled from the damper housing part 120A, is also attached to the main body 126. A hole 126*b* formed in the damper housing part 120A and the fluid outlet 126D communicate with each other through an outlet channel 126B.

The outer convex curved parts 131 formed on the cover 128 are used to allow a spacing S1 below the cover 128 in the metal damper 120 and a spacing S2 above the main body 126 in the metal damper 120 to communicate with each other.

Figure 4:
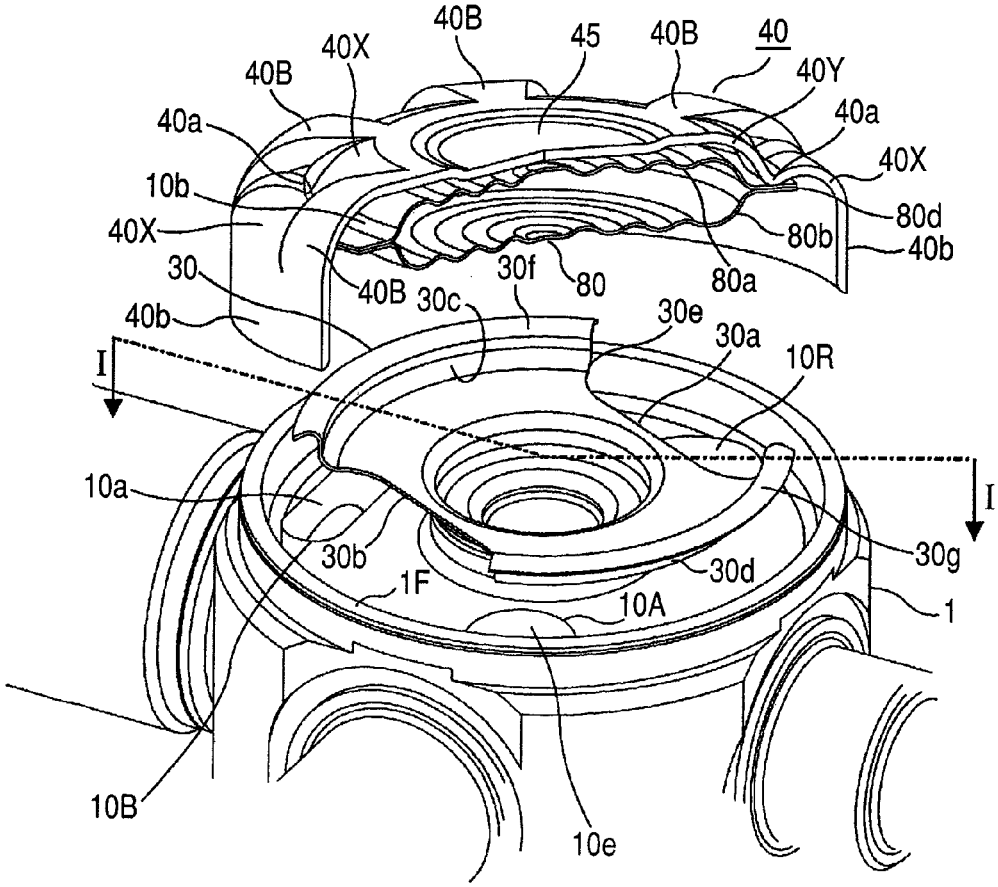
FIG. 4 is a partially exploded perspective view of the fluid pressure damper mechanism in the fourth embodiment of the present invention.

The spacing in the holding member 133 and the spacing S2 above the main body 126 communicate with each other through an opening (the same opening as the opening 30*a* in FIG. 4 is present) that appears when a cross section at a different angle is viewed.

In the metal damper 120 accommodated in the damper housing part 120A, the metal diaphragms 121 and 122 are exposed to a flow of fluid supplied between the fluid inlet 126C and fluid outlet 126D, and contracts and expands in response to changes in the dynamic pressure of pressure pulsation generated in the flow, eliminating the pulsation.

The cover 128 in this embodiment is made of a thin metal plate. If, therefore, pressure pulsation that is too large for the metal damper 120 to eliminate occurs, a discal dent 135 formed in the cover 128 at the center eliminates the pulsation by contracting and expanding.

The cover 128 is formed by pressing a rolled steel, so its thickness is uniform over all parts including the skirt 129, inner convex curved parts 130, outer convex curved parts 131, and discal dent 135. The stiffness of the cover 128 varies with the area; it is lowest at the discal dent 135, and becomes higher little by little at the skirt 129 and outer convex curved part 131 in that order. The stiffness at an area around the end of the inner convex curved part 130 is highest. The force to hold the edge part 124 of the metal damper 120 can thereby be accepted.

The skirt 129 is press-fitted along the periphery of the frame 127, causing a tight contact between the inner peripheral surface of the skirt 129 of the cover 128 and the outer peripheral surface of the frame 127, after which their peripheries are welded at Z1. Due to thermal distortion generated during the welding, the cover 128 is displaced in a direction in which it presses the edge part 124 of the metal damper 120 against the holding member 133. This prevents the force to hold the metal damper from being reduced.

A plurality of outer convex curved parts 130A, each of which has a larger curvature than the outer convex curved part 131, is formed on the inner convex curved part 130 toward the skirt 129, and a plurality of outer convex curved parts 130B, each of which has approximately the same curvature as the outer convex curved part 131, is also formed on the inner convex curved part 130 toward the discal dent 135. A set of these plurality of curved parts ensure a prescribed high stiffness. Accordingly, in this embodiment, the area having high stiffness refers to the area including these curved parts, and the elastic areas or the areas having low stiffness refer to the discal dent 135 and skirt 129. The outer convex curved part 131 has intermediate stiffness and elasticity.

Second Embodiment

Figure 13:
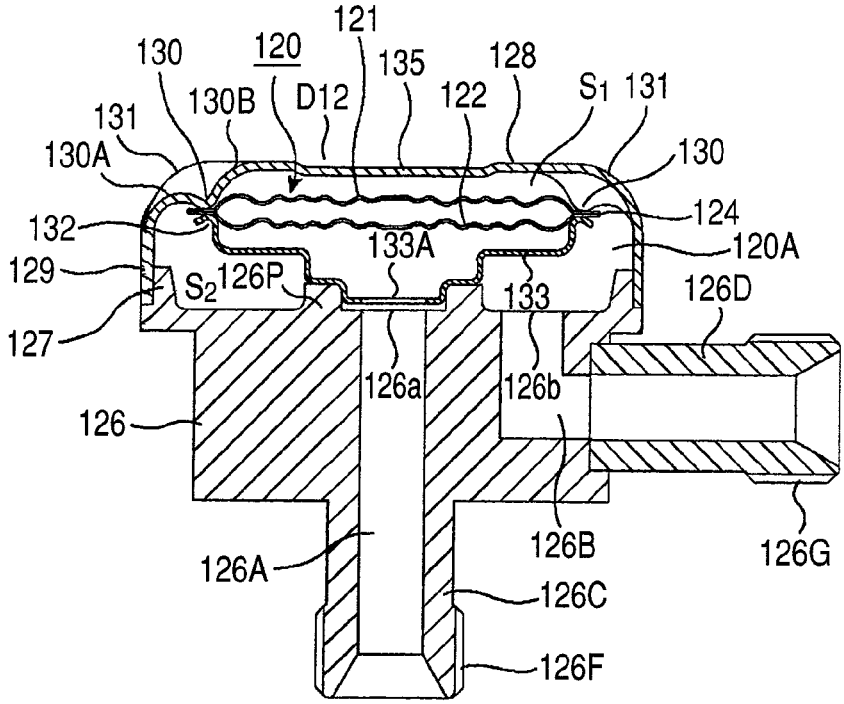
FIG. 13 is a longitudinal sectional view of a fluid pressure damper mechanism in a second embodiment of the present invention.

In a fluid pressure pulsation damping mechanism in a second embodiment shown in FIG. 13, a fluid inlet channel 126A is formed at the center of the main body 126; a hole 126*a*, which is linked to the fluid inlet channel 126A and open to the damper housing part 120A, is formed at the center of an extrusion 126P; another hole 133A is also formed at the center of the holding member 133.

Accordingly, fluid flows from a fluid inlet 126C connected to an upstream pipe at a threaded part 126F through the fluid inlet channel 126A, holes 126*a*, 133A, and 126*b*, the fluid outlet channel 126B, and fluid outlet 126D, to a downstream pipe connected at a threaded part 126G.

Third Embodiment

Figure 14:
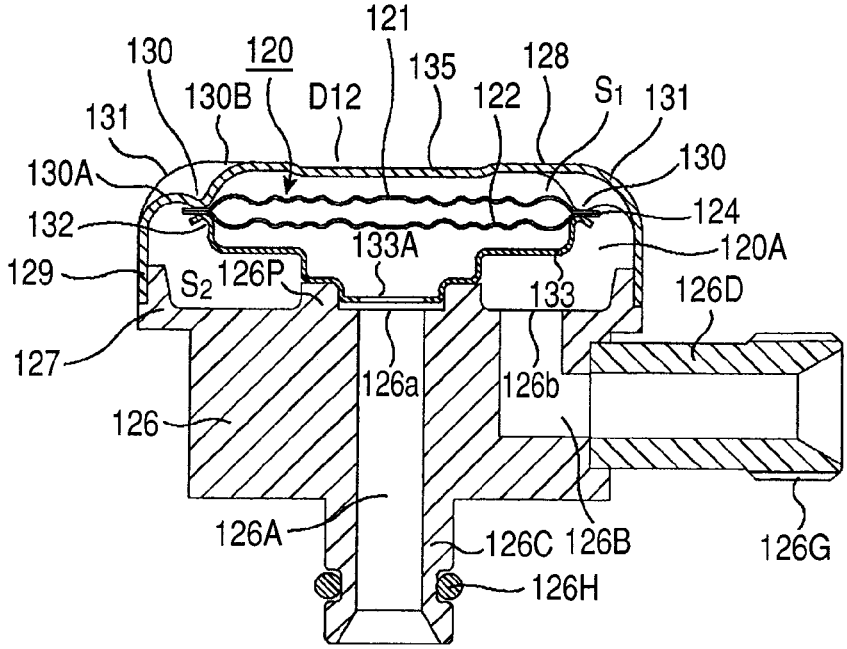
FIG. 14 is a longitudinal sectional view of a fluid pressure damper mechanism in a third embodiment of the present invention.

A fluid pressure pulsation damping mechanism in a third embodiment shown in FIG. 14 indicates that an O-ring 126H can be applied to a connection part of the fluid inlet 126C to which the upstream pipe is connected.

Fourth Embodiment

A high-pressure fuel pump equipped with a fluid pressure pulsation damping mechanism will be described as a fourth embodiment in the present invention in detail, with reference to FIGS. 1 to 4, 7, 10, and 11.

The basic features of the high-pressure fuel pump equipped with a fluid pressure pulsation damping mechanism will be described first while being compared with the fluid pressure pulsation damping mechanism D12 in the first embodiment.

In the embodiment described below, the main body 126 of the fluid pressure pulsation damping mechanism D12 in the first embodiment is configured as a pump body 1 of the high-pressure fuel pump; the pump body 1 has a low-pressure fuel inlet (referred to below as the intake joint) 10 and a fuel outlet (referred to below as the expelling joint) 11.

The pump body 1 also has a fuel pressurizing chamber 12, in which a cylinder 20 is fixed. A plunger 2 is slidable fitted to the cylinder 20. When the plunger 2 reciprocates, fuel supplied through an intake joint 10 is delivered to the pressurizing chamber 12 through an intake valve 203 provided at an intake 12A of the pressurizing chamber 12. The fuel is pressurized in the pressurizing chamber 12 and the pressurized fuel is expelled to the expelling joint 11 through an outlet valve 6 provided at the outlet 12B of the pressurizing chamber 12.

The damper housing part 120A is disposed at an intermediate point of a low-pressure channel formed between the intake joint 10 and intake valve 203. The damper housing part 120A is formed as spacing partitioned by the pump body 1 and cover 128; it internally includes the fluid pressure pulsation damping mechanism D12 equipped with the metal damper 80.

Figure 10:
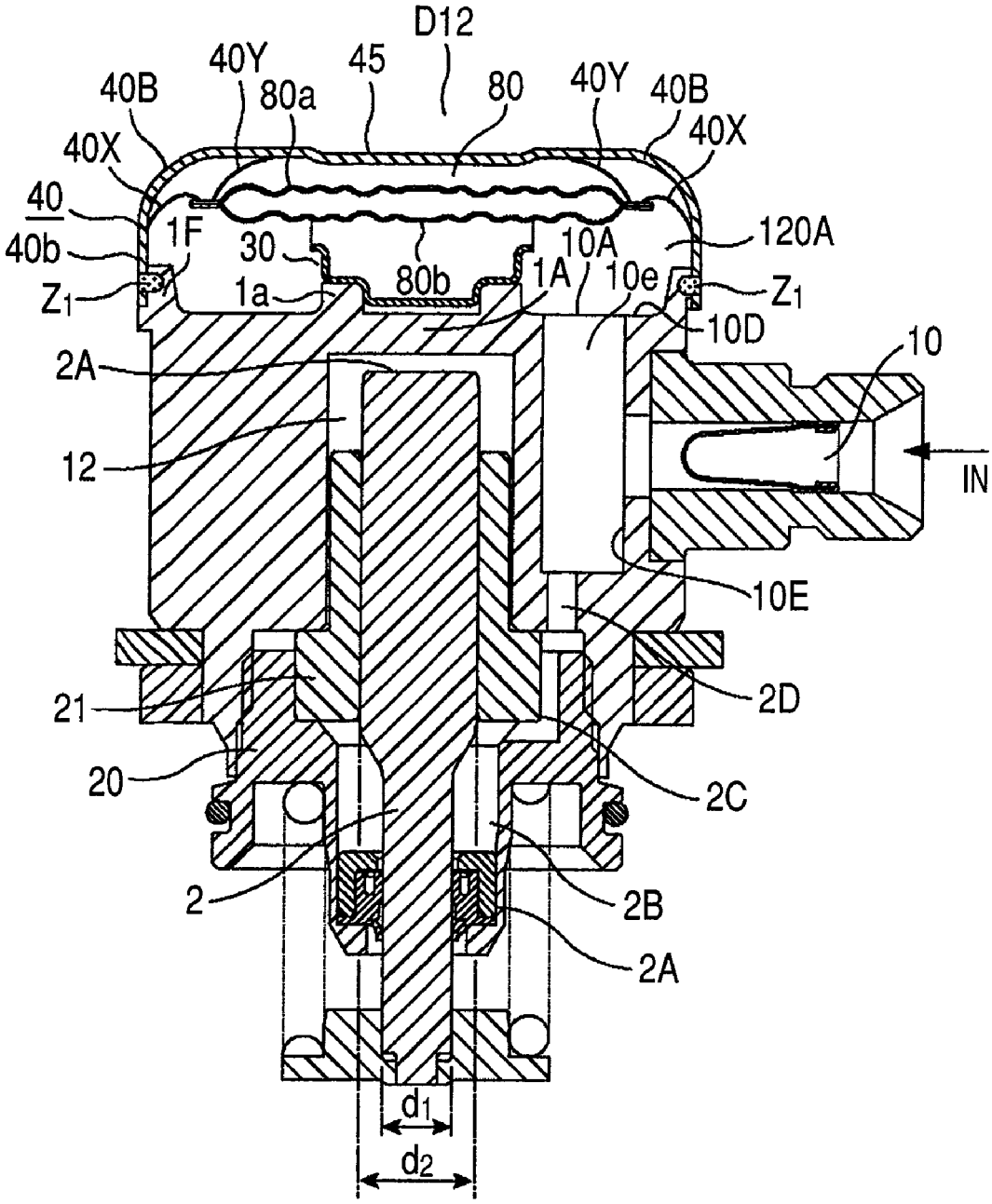
FIG. 10 is a longitudinal sectional view showing section X-X, in FIG. 11, of the high-pressure fuel pump equipped with the fluid pressure damper mechanism in the first embodiment and the fourth embodiment of the present invention.
Figure 11:
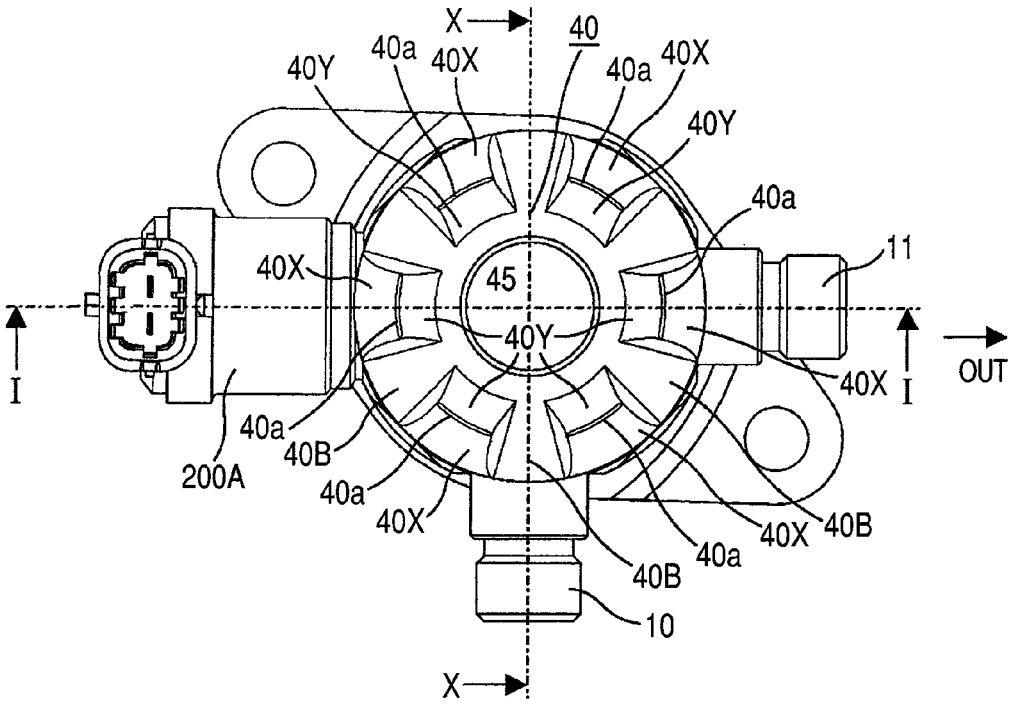
FIG. 11 is a plan view of a high-pressure fuel pump equipped with the fluid pressure damper mechanism in the first embodiment and the fourth embodiment of the present invention.

A shown in FIG. 10, the damper housing part 120A includes a first opening 10A communicating with the intake joint 10 and a second opening 10B communicating with the fuel intake 12A, in which the intake valve 203 is disposed. The fuel intake 12A in the pressurizing chamber 12 and the second opening 10B open to the damper housing part 120A are interconnected by an intake channel 10*a*.

The first opening 10A corresponds to the fluid intake 126*a* of the fluid pressure pulsation damping mechanism in FIG. 12, and the second opening 10B corresponds to the fluid outlet 126*b* of the fluid pressure pulsation damping mechanism in FIG. 12.

Figure 1:
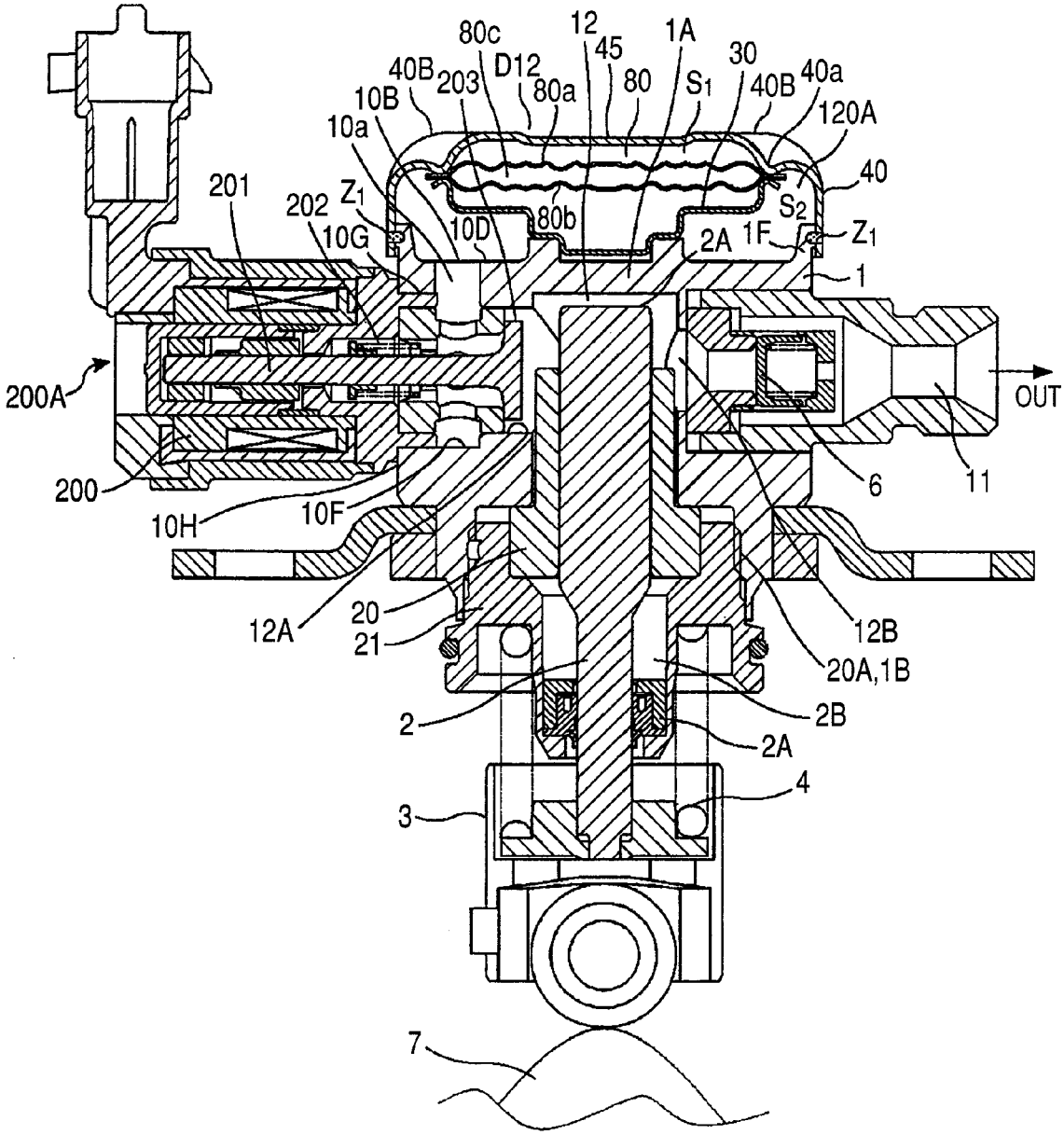
FIG. 1 is an entire longitudinal sectional view of a high-pressure fuel pump equipped with a fluid pressure damper-mechanism in a fourth embodiment of the present invention.

As shown in FIG. 1 and FIG. 10, a seal 2A is attached to an outer periphery of the plunger 2 at a outside of the pressurizing chamber 12. A cylinder holder 21 holds the seal 2A to the outer peripheral surface of the plunger 2. The seal 2A and cylinder holder 21 constitute a fuel reservoir 2B that collects fuel that leaks from the end of the sliding part between the plunger 2 and cylinder 20. Fuel return channels 2C and 2D allow the fuel reservoir 2B to communicate with a low-pressure fuel channel 10*e* formed between the first opening 10A of the damper housing part 120A and the intake joint 10 of the pump body 1.

The diameter d1 of a part on the plunger 2 to which the seal 2A is attached is smaller than the diameter d2 of another part on the plunger 2 over which the plunger 2 fits to the cylinder 20.

As shown in FIG. 10, the first opening 10A in the damper housing part 120A is open to a wall 10D that faces the metal damper 80 in the damper housing part 120A. The low-pressure fuel channel 10*e* disposed between the first opening 10A and the intake joint 10 of the pump body 1 is formed as a first blind hole 10E starting from the first opening 10A and extending parallel to the plunger 2. The fuel reservoir 2B is connected to the blind hole 10E through the fuel return channels 2C and 2D.

As shown in FIG. 1, the second opening 10B in the damper housing part 120A is open to a position other than the first opening 10A in the wall 10D facing the metal damper 80 in the damper housing part 120A. The low-pressure fuel channel 10*a* disposed between the second opening 10B and the intake joint 10 of the pressurizing chamber 12 is formed as a second blind hole 10F starting from the second opening 10B and extending parallel to the plunger 2. A hole 10G for attaching the intake valve 203 to the pump body 1 starts from the outer wall 10H of the pump body 1, traverses the second blind hole 10F, and extends to the pressurizing chamber 12.

The damper housing part 120A is an isolating wall, which is part of the pressurizing chamber 12 of the pump body 1. The damper housing part 120A isolates a wall 1A facing the end surface 2A, close to pressurizing chamber 12, of the plunger 2, and is formed on the outer wall of the pump body 1 located outside the pressurizing chamber 12.

The first and second openings 10A and 10B are made on this outer wall. The cover 40 is fixed to the pump body 1 in such a way that it covers these openings 10A and 10B.

The embodiment will be described below in detail with reference to FIGS. 1 to 4, 7, 10, and 11.

As shown in FIG. 1, the expelling joint 11 has an expelling valve 6. The expelling valve 6 is urged by a spring 6*a* in a direction in which the expelling hole 12B in the pressurizing chamber 12 is closed. The expelling valve 6 is a so-called non-return valve that limits a direction in which fuel flows.

An intake valve mechanism 200A is unitized as an assembly comprising a solenoid 200, a plunger rod 201, a spring 202, and a flat valve, the intake valve 203 being attached to the assembly. The intake valve 203 inserted from the hole 10G through the intake channel 10*a* into the fuel take 12A of the pressurizing chamber 12. The solenoid 200 blocks the hole 10G and the intake valve mechanism is fixed to the pump body 1.

When the solenoid 200 is turned off, the plunger rod 201 is urged by the spring 202 in a direction in which a flat valve of the intake valve 203 closes the fuel intake 12A. Accordingly, when the solenoid 200 is turned off, the plunger rod 201 and intake valve 203 are in a closed state, as shown in FIG. 1.

Figure 2:
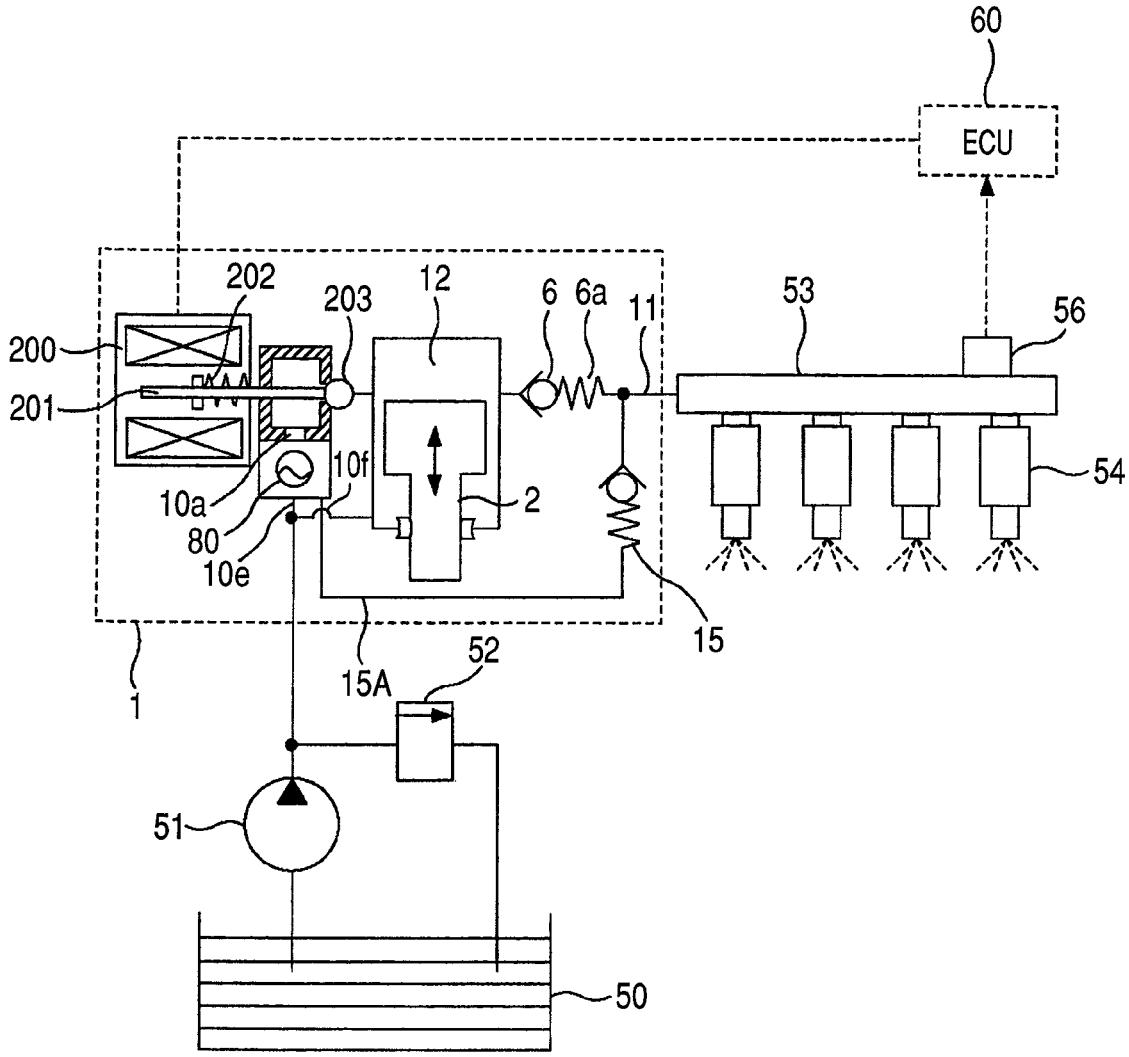
FIG. 2 is a structural view illustrating an example of a fuel supply system of an internal combustion engine to which a high-pressure fuel pump equipped with a fluid pressure damper mechanism of the present invention is applied.

As shown in FIG. 2, fuel is supplied under a low pressure by a low-pressure pump 51, from a fuel tank 50 to the intake joint 10 of the pump body 1. In this case, the fuel is regulated to a fixed pressure by a pressure regulator 52 operating at a low pressure. The fuel is then pressurized by the pump body 1 and the pressurized fuel is delivered from the expelling joint 11 to a common rail 53.

The common rail 53 includes injectors 54 and a pressure sensor 56. The number of injectors 54 included is equal to the number of cylinders of the engine. Each injector 54 injects fuel into the cylinder of the engine in response to a signal from an engine control unit (ECU) 60. When the pressure in the common rail 53 exceeds a prescribed value, a relief valve 15 in the pump body 1 opens and part of the high-pressure fuel is returned through a relief channel 15A to an opening 10*f* open to the damper housing part 120A, thereby preventing the high-pressure piping from being damaged.

A lifter 3, which is disposed at the bottom of the plunger 2, is placed in contact with a cam 7 by means of a spring 4. The plunger 2 is slidably held in the cylinder 20, and reciprocates when the cam 7 is rotated an engine cam shaft or the like, changing the volume of the pressurizing chamber 12.

As shown in FIG. 1, the cylinder 20 is held by a cylinder holder 21 on its outer surface. When threads 20A formed on the outer surface of the cylinder holder 21 are screwed into threads 1B formed on the pump body 1, the cylinder holder 21 is fixed to the pump body 1.

In this embodiment, the cylinder 20 just slidably holds the plunger 2, and lacks a pressurizing chamber, providing the effect that the cylinder made of a hard material, which is hard to machine, can be machined to a simple shape.

When the solenoid 200 of the intake valve mechanism 200A is turned off during a compressing process of the plunger 2 and then the plunger rod 201 moves to the left side in FIG. 1 due to the force by the spring 202 and the fuel pressure in the pressurizing chamber 12, the intake valve 203 closes the fuel intake 12A of the fuel pressurizing chamber 12. The pressure in the pressurizing chamber 12 then starts to rise. In response to this, the expelling valve 6 automatically opens and the pressurized fuel is delivered to the common rail 53.

When the pressure in the fuel pressurizing chamber 12 falls below the pressure in the intake joint 10 or low-pressure fuel channel 10*a*, the plunger rod 201 in the intake valve mechanism 200A opens the intake valve 203. When to open the intake valve 203 is set according to the force by the spring 202, a difference in fluid pressure between the front and back of the intake valve 203, and the electromagnetic force of the solenoid 200.

With the solenoid 200 turned on, an electromagnetic force greater than the force of the spring 202 is generated, so the plunger rod 201 opposes the force of the spring 202 and is pushed to the right side in the drawing. The intake valve 203 is then separated from the seat, opening the intake valve 203.

With the solenoid 200 turned off, the plunger rod 201 engages the seat due to the force of the spring 202, keeping the intake valve 203 closed.

The solenoid 200 is kept turned on and fuel is supplied to the pressurizing chamber 12 while the plunger 2 is in an intake process (it moves downward in the drawing). The solenoid 200 is turned off at an appropriate point in time in a compression process (it moves upward in the drawing) and the intake valve 203 is moved to the left side in the drawing to close the fuel intake 12A, causing the fuel remaining in the pressurizing chamber 12 to be delivered to the common rail 53.

When the solenoid 200 is kept turned on in the compression process, the pressure in the pressurizing chamber 12 is kept to a low level almost equal to the pressures in the intake joint 10 or low-pressure fuel channel 10*a*, preventing the expelling valve 6 from being opened. Fuel is returned to the low-pressure fuel channel 10*a* by the amount by which the volume of the pressurizing chamber 12 is reduced.

Accordingly, if the solenoid 200 is turned back off in the middle of the compression process, fuel is then delivered to the common rail 53, so the amount of fuel expelled by the pump can be controlled.

While the plunger 2 is reciprocating, three processes, that is, intake from the intake joint 10 to the pressurizing chamber 12, expelling from the pressurizing chamber 12 to the common rail 53, and return from the pressurizing chamber 12 to the fuel intake channel, are repeated. As a result, fuel pressure pulsation occurs in the low-pressure fuel channel.

Figure 3:
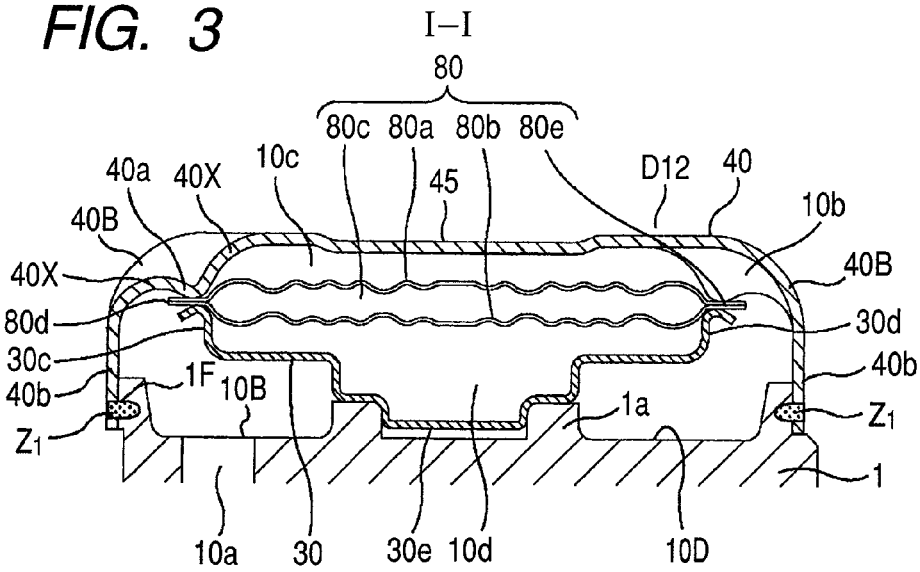
FIG. 3 is a partially enlarged view of the fluid pressure damper mechanism in the fourth embodiment of the present invention.

A mechanism for reducing fuel pressure pulsation in the fourth embodiment will be described next with reference to FIGS. 3 and 4. FIG. 3 is an enlarged view of the mechanism, and FIG. 4 is a perspective view of a holding mechanism of a damper for reducing fuel pressure pulsation.

A two-metal-diaphragm damper 80 is formed by welding the outer edges 80*d* of two diaphragms 80*a* and 80*b*; an internal spacing 80*c* includes a sealed gas. Since the two-metal-diaphragm damper 80 changes its volume in response to an external change in pressure, it functions as a sensing element that has a pulsation damping function.

Each of the two diaphragms 80*a* and 80*b* is a thin disk having a bulge at its center. Their dents are made to face each other, and the two diaphragms 80*a* and 80*b* are concentrically matched. A gas is included in the sealed spacing 80*c* formed between the two diaphragms 80*a* and 80*b*. A plurality of concentric pleats is formed on the diaphragms 80*a* and 80*b* so that they can be elastically deformed with ease in response to a change in pressure; their cross sections are wavy. The two diaphragms 80*a* and 80*b* each have a flat part 80*e* along the outer periphery of the bulge on which the pleats are formed. The outer edges 80*d* of the two matched diaphragms 80*a* and 80*b* are joined by being welded over their entire peripheries. Due to the welding, the gas in the sealed spacing 80*c* does not leak.

The pressure of the gas in the sealed spacing 80*c* is higher than the atmospheric pressure, but the gas pressure can be adjusted to any level during manufacturing, according to the pressure of the fluid to be handled. The gas filled is, for example, a mixture of argon gas and helium gas. A leak detector is sensitive to a leak of the helium gas from the welded part, and the argon gas is hard to leak. Accordingly, a leak from the welded part, if any, can be easily detected, and it cannot be considered that the gasses leak completely. The ratios of the mixed gases are determined so that a leak is hard to occur and, if any, can be easily detected.

The diaphragms 80*a* and 80*b* are made of precipitation hardened stainless steel, which is superior in corrosion in fuel and strength. The two-metal-diaphragm damper 80 is included in the damper housing part 120A disposed between the intake joint 10 and low-pressure fuel channel 10*a*, as the mechanism for reducing the fuel pressure pulsation.

The two-metal-diaphragm damper 80 is held between the damper holder 30 held on the pump body 1 and the damper cover 40 forming the damper housing part 120A.

Although the entire cross section of the damper holder 30 is a cup-shaped cross section, it has cutouts 30*e* formed by cutting part of the damper holder 30 in the peripheral direction, so as to obtain fuel channels through which the inside and outside communicate with each other.

Along the outer edge of the damper holder 30, peripheral walls 30*c* and 30*d* erect on areas, which have a diameter larger than the bulge on which concentric pleats are formed on the metal diaphragm damper 80. Curled parts 30*f* and 30*g* are respectively formed on the upper ends of the peripheral walls 30*c* and 30*d*. The curled parts 30*f* and 30*g* touch the flat part of the lower ring-shaped flat part 80*e* formed along the outer periphery of the metal diaphragm dampers 80, supporting the metal diaphragm damper 80 and radially positioning it.

A downward protrusion 30*e* is formed at the center of the damper holder 30. When the downward protrusion 30*e* is inserted into the inner peripheral part of a ring-shaped extrusion 1*a* formed on the wall 10D of the pump body 1, the damper holder 30 is radially positioned with respect to the pump body 1.

A plurality of inner convex curved parts 40*a* is formed on the inner surface of a damper cover 40. The inner convex curved parts 40*a* is corresponding to the inner convex curved part 130 shown in FIG. 12. The vertexes of the plurality of inner convex curved parts 40*a* are formed at intervals on a circumference positioned inside the outer diameter of the metal diaphragm damper 80, so that the vertexes are positioned on the ring-shaped flat parts 80*e* of the metal diaphragm damper 80. When the damper cover 40 is joined to the pump body 1, the metal diaphragm damper 80 is also held between the pump body 1 and the curled parts 30*f* and 30*g* of the damper holder 30. As in the embodiment in FIG. 12, the end of the inner convex curved part 40*a* is flattened as shown in FIG. 7 to form a flat part 40*f*, providing the same effect as illustrated in FIG. 12.

An outer convex curved part 40B is formed between two adjacent inner convex curved parts 40*a*. The outer convex curved parts 40B is corresponding to the outer convex curved part 131 shown in FIG. 12. The outer convex curved part 40B functions as a fuel channel through which the inside and outside of the two-metal-diaphragm damper 80 communicate with each other, and thereby can provide a dynamic pressure in the same low-pressure fuel channel to the outer peripheries of the metal diaphragms 80*a* and 80*b*, improving the pulsation elimination function of the damper.

The inner convex curved part 40*a* and outer convex curved part 40B on the damper cover 40 are formed by pressing, so their costs can be reduced. A ring-shaped skirt 40*b* of the damper cover 40 is disposed so that its inner periphery faces the outer periphery of a ring-shaped frame 1F protruding up to the outer surface of the pump body 1 (the outer surface of the isolating wall 1A of the pressurizing chamber 12 corresponding to the end of the plunger 2). In this state, the entire outer periphery of the skirt 40*b* of the damper cover 40 is welded. Accordingly, the damper cover 40 can be fixed to the pump body 1 and hermetic seal in the internal damper housing part 120A can also be obtained.

The damper cover 40 is formed by pressing a rolled steel, so its thickness is uniform over all parts including the skirt 40*b*, inner convex curved parts 40*a*, outer convex curved parts 40B, and discal dent 45. The stiffness of the cover depends on the area; it is lowest at the discal dent 45, and becomes higher little by little at skirt 40*b* and outer convex curved part 40B in that order. The stiffness around the end of the inner convex curved part 40*a* is highest. The force to hold the ring-shaped flat parts 80*e* of the metal diaphragm damper 80 can thereby be accepted.

The skirt 40*b* is press-fitted along the periphery of the frame 1F, causing a tight contact between the inner peripheral surface of the skirt 40*b* of the damper cover 40 and the outer peripheral surface of the frame 1F, after which their peripheries are welded at Z1. Due to thermal distortion generated during the welding, the damper cover 40 is displaced in a direction in which it presses the ring-shaped flat parts 80*e* disposed around the outer periphery of the metal diaphragm damper 80 against the damper holder 30, which is used as a holding member. This prevents the force to hold the metal diaphragm damper from being reduced.

A plurality of outer convex curved parts 40X, each of which has a larger curvature than the outer convex curved parts 40B, is formed toward the skirt 40*b* of the inner convex curved part 40*a*, and a plurality of outer convex curved parts 40Y, each of which has approximately the same curvature as the outer convex curved parts 40B, is formed toward the discal dent 45 in the inner convex curved part 40*a*. A set of these plurality of curved parts ensures a prescribed high stiffness. Accordingly, in this embodiment, the area having a high stiffness refers to the area including these curved parts, and the elastic areas or the areas having low stiffness refer to the discal dent 45 and skirt 40*b*. The outer convex curved part 40B has intermediate stiffness and elasticity.

Accordingly, the ring-shaped flat parts 80*e* on the outer periphery of the two-metal-diaphragm damper 80 are held between the flat part 40*f* at the end of the inner convex curved part 40*a* on the damper cover 40 and the curled parts 30*f* and 30*g* of the damper holder 30. Since the force to hold the metal diaphragm damper 80 does not act on the outer peripheral edge 80*d*, it can be possible to prevent the two-metal-diaphragm damper 80 from being damaged due to concentrated stress.

Due to the holding force, the damper cover 40 causes a tight contact between the damper holder 30 and metal diaphragm damper 80. The lower edge of the skirt 40*b* of the damper cover 40 is placed in contact with the pump body 1 while the damper cover 40 is pressed against the pump body 1. The entire periphery of the skirt 40*b* of the damper cover 40 is then welded at Z1 to fix it. Thermal shrinkage caused by the welding further causes distortion in a direction in which the inner convex curved parts 40*a* on the damper cover 40 are always pressed against the pump body 1, making the holding force after the welding stable.

Accordingly, the metal diaphragm damper 80 can be reliably held with a small number of parts, and the pressure pulsation of fuel can be stably transmitted to the metal diaphragm damper 80, so the pulsation can be stably eliminated. In addition, members for pressing the metal diaphragm damper 80 in the damper chamber can be lessened, so the whole length of the pump along the plunger can be shortened, enabling the size and cost of the pump to be reduced.

To eliminate variations in manufacturing, it is also possible for the damper holder 30 to have distortion to a certain level in advance during a process of assembling. In this case, the metal diaphragm damper 80 is supported by the cup-shaped outer periphery and fixed to the pump body 1 by means of the ring-shaped protrusion 30*e* formed at the center. The cross section of this structure is shaped like a cantilever, so the amount of distortion can be adjusted easily by changing the plate thickness or positioning at the center. However, the amount of distortion must be adjusted so that the holding force is kept greater than an external force exerted on the metal diaphragm damper 80 because of pressure pulsation of the fuel.

When the number of inner convex curved parts 40*a* on the damper cover 40 and their width are determined according to the shape of the touched part of the damper holder 30, the ring-shaped flat parts 80*e* on the outer periphery of the two-metal-diaphragm damper 80 can be held in a well-balanced state.

Fuel chambers 10*c* and 10*d* used as the damper housing part 120A, in which the metal diaphragm damper 80 is accommodated, communicate with the low-pressure fuel channel 10*a*, which leads to the inlet of the pressurizing chamber 12.

Accordingly, the fuel can also flow freely into and out of the fuel chamber 10*c* through the low-pressure fuel channel 10*b* formed by the outer convex curved part 40B on the damper cover 40, enabling the fuel to be supplied to both surfaces of the two-metal-diaphragm damper 80. The fuel pressure pulsation can then be eliminated efficiently.

Fifth Embodiment

Figure 5:
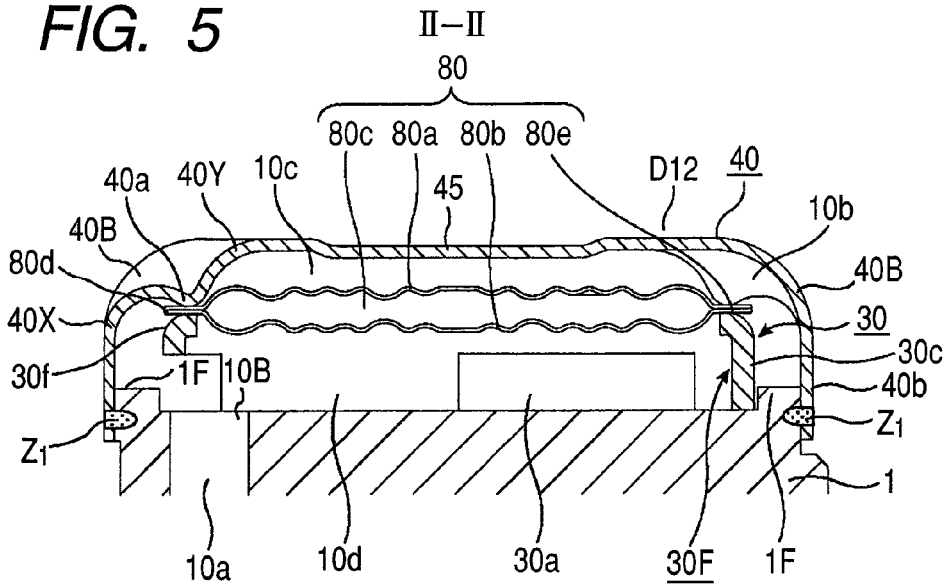
FIG. 5 is a partially enlarged view of a fluid pressure damper mechanism in a fifth embodiment of the present invention.
Figure 6:
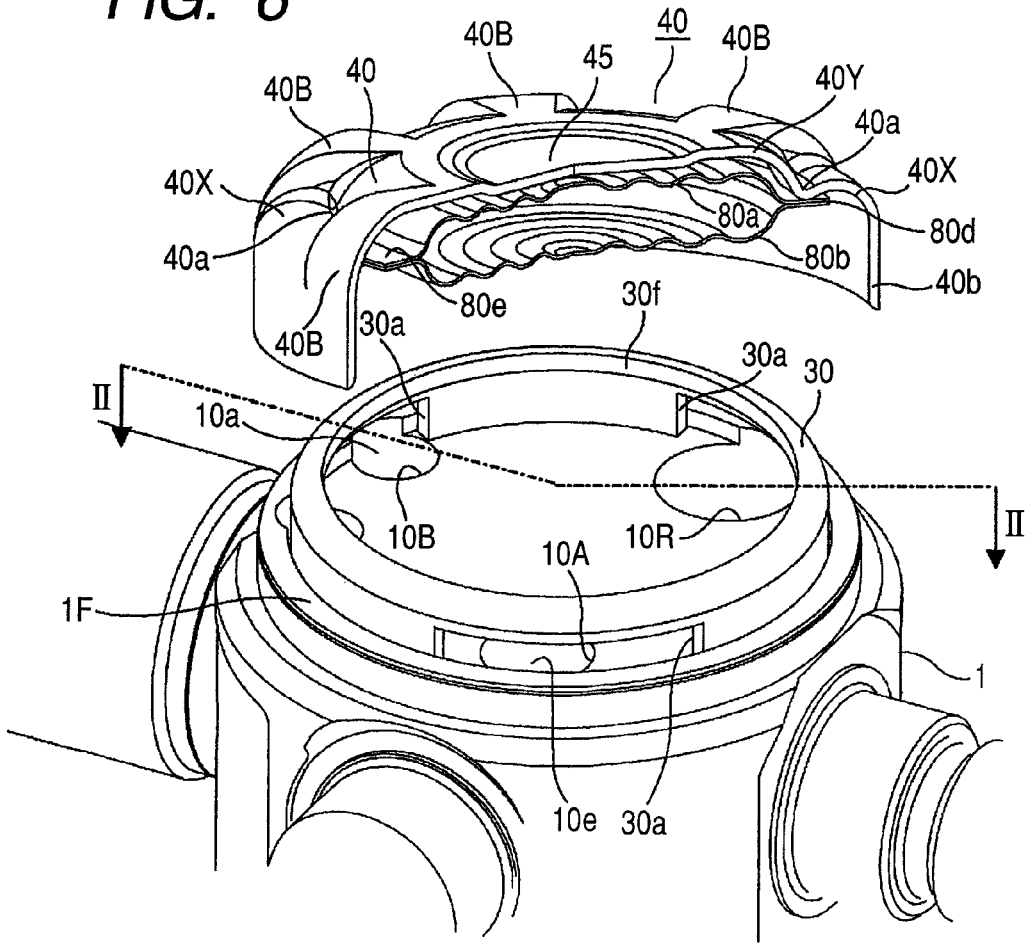
FIG. 6 is a partially exploded perspective view of the fluid pressure damper mechanism in the fifth embodiment of the present invention.

A fluid pressure pulsation damping mechanism in a fifth embodiment of the present invention will be described next with reference to FIGS. 5 and 6.

The ring-shaped flat parts 80*e* on the outer periphery of the two-metal-diaphragm damper 80 are held between the damper holder 30 and the inner convex curved parts 40*a* on the damper cover 40, as in the fourth embodiment.

The damper cover 40 internally has a plurality of inner convex curved parts 40*a*, as described above. The lower peripheral ring-shaped flat part 80*e* of the metal diaphragm damper 80 is supported by the vertexes of the inner convex curved parts 40*a*.

The damper holder 30 includes a cylindrical metal member 30F having stiffness, which is formed separately from the pump body 1. A curved surface 30*f*, which is curved toward the inner diameter, is formed on the upper surface of the cylindrical metal member 30F. The metal diaphragm damper 80 is set so that the lower surface of the ring-shaped flat parts 80*e* on the outer periphery of the metal diaphragm damper 80 touches the curved surface 30*f*. The ring-shaped flat parts 80*e* on the outer periphery of the metal diaphragm damper 80 are held between the damper holder 30 and the inner convex curved parts 40*a* on the damper cover 40 placed from above.

The inner diameter of the curved surface 30*f* at the upper end of the damper holder 30 is a little larger than the diameter of the bulge of the metal diaphragm damper 80. The bulge on which pleats of the metal diaphragm damper 80 are formed fits to the inside of the cylindrical metal member 30F, radially positioning the metal diaphragm damper 80.

Several cutouts 30*a* are formed on the outer cylindrical part 30*c* of the damper holder 30 so as to obtain fuel channels. The fuel flows into and out of the fuel chamber 10*d* through the cutouts 30*a*. The fuel also flows into and out of the fuel chamber 10*c* through a low-pressure fuel channel 10*b* formed by the outer convex curved parts 40B formed on the damper cover 40. As a result, the fuel can be delivered to both sides of the two-metal-diaphragm damper 80, effectively eliminating the fuel pressure pulsation.

The damper holder 30 is radially positioned by the outer cylindrical part 30*c* attached along the frame 1F, which forms the damper housing part 120A of the pump body 1.

In this embodiment, the axial positioning of the damper cover 40 is determined by managing a dimension from the lower end of the cylindrical metal member 30F to its upper end. For this reason, the dimension of the skirt 40*b* of the damper cover 40 is determined so that the lower surface of the skirt 40*b* does not touch the pump body 1.

As described above, the two-metal-diaphragm damper 80 is held by the front and back of the peripheral ring-shaped flat parts 80*e*, and the outer peripheral edge 80*d* is not held, so there is no risk that the two-metal-diaphragm damper 80 is damaged due to concentrated stress.

The lower side of the two-metal-diaphragm damper 80 fits to the entire periphery of the damper holder 30, so it can be freely set to the positions at which the inner convex curved parts 40*a* are formed on the damper cover 40 disposed at the opposite position.

The damper holder 30 is formed by pressing, so its cost can be reduced.

Due to the holding force, the damper cover 40 causes a tight contact between the damper holder 30 and metal diaphragm damper 80, as described above. The entire periphery of the skirt 40*b* is then welded at Z1 to the pump body 1 to fix the skirt 40*b* while the damper cover 40 is pressed against the pump body 1. Thermal shrinkage caused by the welding further causes distortion by which the inner convex curved parts 40*a* on the damper cover 40 are always deformed toward the pump body 1. Accordingly, there is no risk that the holding force is weakened after the welding and thereby the metal diaphragm damper 80 becomes unstable.

Accordingly the metal diaphragm damper 80 can be reliably held with a small number of parts, and the pressure pulsation of fuel can be stably transmitted to the metal diaphragm damper 80, so the pulsation can be stably eliminated. In addition, members for pressing the metal diaphragm damper 80 in the damper chamber can be lessened, so the whole length of the pump can be shortened, enabling the size and cost of the pump to be reduced.

Sixth Embodiment

A fluid pressure pulsation damping mechanism in a sixth embodiment of the present invention will be described next with reference to FIGS. 8 and 9.

Figure 8:
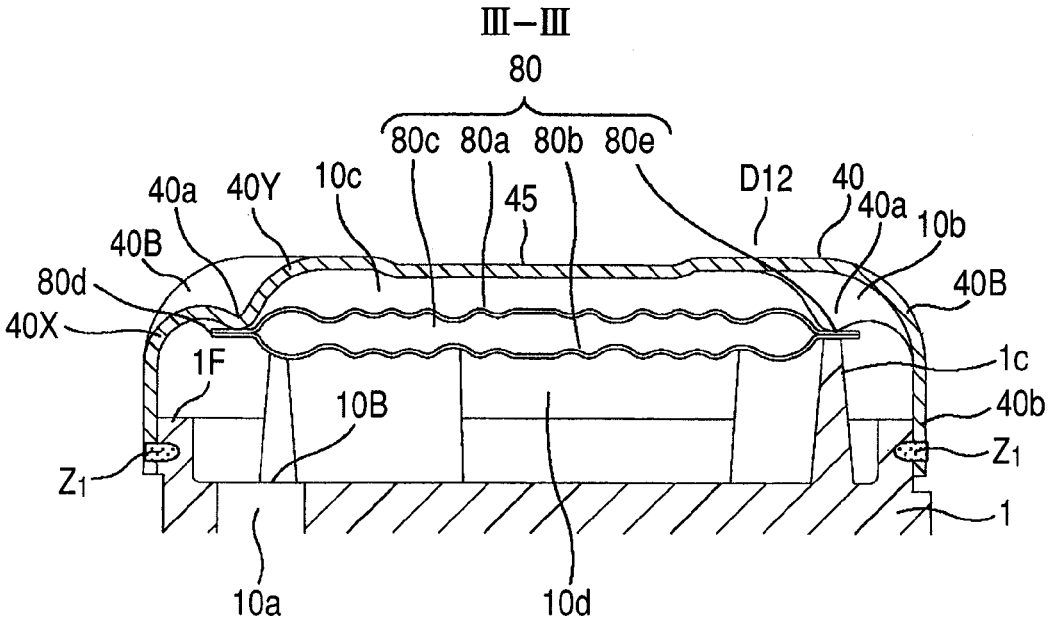
FIG. 8 is a partially enlarged view of a fluid pressure damper mechanism in a sixth embodiment of the present invention.
Figure 9:
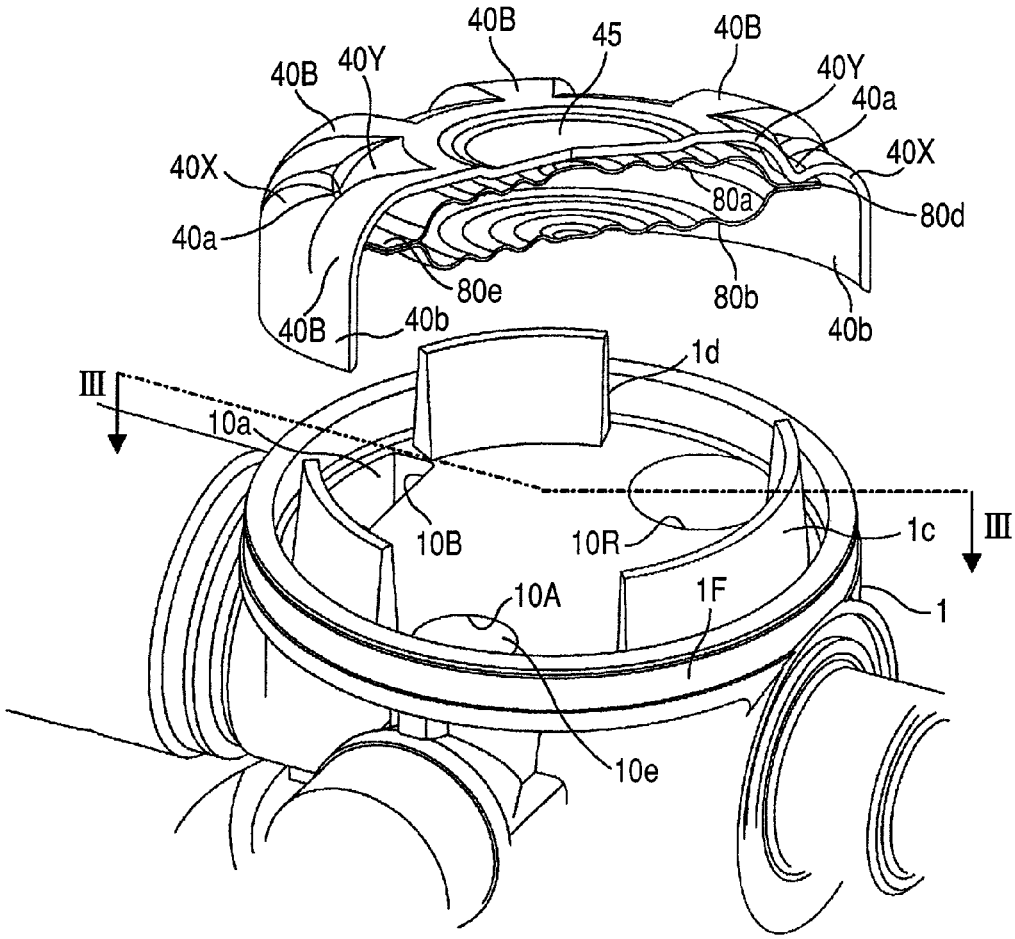
FIG. 9 is a partially exploded perspective view of the fluid pressure damper mechanism in the sixth embodiment of the present invention.

As shown in FIGS. 8 and 9, the two-metal-diaphragm damper 80 is structured so that the peripheral ring-shaped flat parts 80*e* are held between the inner convex curved parts 40*a* on the damper cover 40 and the upper ends of a plurality of arc-shaped protrusions 1*c* integrally formed on the pump body 1.

The damper cover 40 internally has a plurality of inner convex curved parts 40*a*, as described above. The upper peripheral ring-shaped flat parts 80*e* of the metal diaphragm damper 80 are supported by the vertexes of the inner convex curved parts 40*a*. The low-pressure fuel channel 10*a* communicates with the fuel chamber 10*c* through the low-pressure fuel channel 10*b*, which is formed by the outer convex curved part 40B formed between the inner convex curved part 40*a* on the inner surface of the metal diaphragm damper 80 and the inner convex curved part 40*a*.

The pump body 1 is made of cast metal, and integrally has a plurality of arch-shaped protrusions 1*c* in the damper housing part 120A. The protrusions 1*c*, which are formed along a diameter a little greater than the pleat of the metal diaphragm damper 80, protrude from the outer surface 10D of the pump body 1 at positions opposite to the inner convex curved parts 40*a* on the damper cover 40. The ends of the protrusions 1*c* support the lower peripheral ring-shaped flat part 80*e* of the metal diaphragm damper 80, and radially position the metal diaphragm damper 80. Since the dumper holders 1*c* are integrated with the pump body 1 in this way, the number of parts can be reduced.

In this embodiment as well, the outer peripheral edge 80*d* of the two-metal-diaphragm damper 80 is not held, so there is no risk that the two-metal-diaphragm damper 80 is damaged due to concentrated stress.

Cutouts 1*d* are partially formed on the ring-shaped protrusion 1*c* on the pump body 1, enabling the fuel chamber 10*c* and low-pressure fuel channel 10*a* to communicate with each other. As a result, the fuel can be delivered to both sides of the two-metal-diaphragm damper 80, effectively eliminating the fuel pressure pulsation.

Due to the holding force, the damper cover 40 is placed in tight contact with the metal diaphragm damper 80. The outer surface 40*b* of the damper cover 40 is fixed to the pump body 1 by welding at Z1 while the damper cover 40 is pressed against the pump body 1. Thermal shrinkage caused by the welding further causes distortion in a direction in which the inner convex curved parts 40*a* on the damper cover 40 are always pressed against the pump body 1. Accordingly, there is no risk that the holding force of the two-metal-diaphragm damper 80 is weakened after the welding and thereby the metal diaphragm damper 80 becomes unstable.

Accordingly the metal diaphragm damper 80 can be reliably held with a small number of parts, and the pressure pulsation of fuel can be stably transmitted to the metal diaphragm damper 80, so the pulsation can be stably eliminated. In addition, members for pressing the metal diaphragm damper 80 in the damper chamber can be lessened, so the whole length of the pump can be shortened, enabling the size and cost of the pump to be reduced.

To achieve the object of providing a compact, inexpensive high-pressure fuel pump that ensures stable pulsation reduction, a metal damper has been formed by welding two metal diaphragms along their peripheries in the fourth to sixth embodiments described above. An entire or partial periphery of the metal damper is held inside the welded part between a pair of pressing members, which are oppositely disposed, and fixed to the damper chamber.

One of the pair of the pressing members is the damper cover 40, which is part of the damper chamber. The inner convex curved parts 40*a* formed on the inner surface of the damper cover 40, which extrude toward the pump body 1, directly support the damper. The opposite pressing member is a cup-shaped damper holder 30, a ring-shaped protrusion formed integrally with the pump body 1, or a plurality of protrusions formed integrally with the pump body 1 with a predetermined spacing.

Accordingly, the two-metal-diaphragm damper 80 with two metal diaphragms 80*a*, 80*b* welded on their peripheries can be fixed in a simple manner, and thereby these embodiments can provide a high-pressure fuel pump 1 with less parts that has easy-to-adjust fuel pressure pulsation elimination characteristics and can supply fuel to the fuel injection valve under stable pressure.

Specifically, the peripheral ring-shaped flat part 80*e* of the two-metal-diaphragm damper 80 is directly supported by a plurality of inner convex curved parts 40*a* formed on the inner surface of the damper cover 40 to reduce the number of parts. In addition, outer convex curved parts 40B, which are formed among the plurality of inner convex curved parts 40*a*, can be used as fuel channels, so a structure for delivering fuel to both sides of the two-metal-diaphragm damper 80 can be formed with less parts and by simple machining.

The features of these embodiments are summarized below as specific aspects.

(First Aspect)

A high-pressure fuel pump having a damper chamber that includes a discal damper formed by joining two metal diaphragms and is disposed in an intermediate point of a channel between an intake channel and a pressurizing chamber, the damper chamber being formed by joining the outer wall of a pump body and a damper chamber cover to the edge of the pump body; the discal damper is disposed in such a way that the damper chamber is partitioned into two parts, one part facing the pump body and the other facing the damper cover; the damper is held between a damper holder supported on the pump body and the inner surface of the damper cover, one side of the damper being supported by the damper holder, the other side being directly supported by the inner surface of the damper cover.

(Second Aspect)

In the high-pressure fuel pump described in the first aspect, the damper cover has a plurality of protrusions on its inner surface; the plurality of protrusions supports one side of the damper at two or more point or on two or more planes.

(Third Aspect)

In the high-pressure fuel pump described in the second aspect, the plurality of protrusions on the inner surface of the damper cover is convex-concave protrusions formed integrally with the pump body by pressing.

(Fourth Aspect)

In the high-pressure fuel pump described in the third aspect, the damper holder, which supports the one side of the damper, is a ring-shaped protrusion formed integrally with the pump body by casting or the like.

(Fifth Aspect)

In the high-pressure fuel pump described in the fourth aspect, the damper holder formed integrally with the pump body is a plurality of protrusions and supports the damper at two or more points or on two or more planes.

(Sixth Aspect)

In the high-pressure fuel pumps described in the first to third aspects, the damper holder supported on the pump body is an elastic member.

(Seventh Aspect)

In the high-pressure fuel pump described in the sixth aspect, the damper holder is discal, the cross section of which is cup-shaped; the outer periphery of the damper holder supports the damper; a protrusion provided at the center of the damper holder fits to a housing part formed on the pump body, positioning and fixing the damper.

(Eighth Aspect)

In the high-pressure fuel pump described in the seventh aspect, the damper holder has cutouts or holes at some parts to form fuel channels.

(Ninth Aspect)

In the high-pressure fuel pumps described in the first to eighth aspects, the damper cover, which directly supports the damper, is an elastic member.

(Tenth Aspect)

In the high-pressure fuel pumps described in the first to ninth aspects, the outer periphery of the damper cover is welded to the pump body, and thereby a welded joint structure is provided in which the damper cover is deformed by contraction after the welding in a direction in which the inner surface of the damper cover is pressed toward the pump body and thereby the dumper is held between the damper cover and the damper holder.

According these aspects of the embodiments described above, the following results can be achieved.

In the embodiments of the present invention, inner convex curved parts used as the damper holder are formed by pressing a thin metal plate. Each inner convex curved part has significant stiffness, and prescribed elasticity is posed around the inner convex curved part. A resulting effect is that a force to hold the damper can be adjusted in a wide range.

The metal diaphragm assembly (also referred to as the two-metal-diaphragm damper) can be held by a simple structure, and the effect of reducing pressure pulsation of low-pressure fuel can be stabilized. The fuel can thereby be supplied to the fuel injection valve under stable pressure.

The cover itself has elasticity, by which if pulsation that is too large for the damper to eliminate occurs, the pulsation can be eliminated. Accordingly, a compact damper mechanism having a large effect of reducing fuel pressure pulsation is obtained.

The cover itself is also used to hold the damper, reducing the number of parts and achieving a simple structure.

The number of parts for fixing the metal damper can be reduced, and thereby the structure is simplified. The force to hold the metal damper can be adjusted with ease. As a result, a stable pulsation reduction effect is obtained.

In addition to the features described above, the high-pressure fuel pump equipped with this fluid pulsation damper mechanism is compact and lightweight, and can be assembled easily, when compared with a fuel pump to which a damper mechanism is integrally attached.

The present invention can be applied to various types of fluid transfer systems as a damper mechanism for reducing fluid pulsation. The present invention is particularly preferable when the damper mechanism is used as a fuel pressure pulsation mechanism attached to a low-pressure fuel channel of a high-pressure fuel pump that pressurizes gasoline and expels the pressurized gasoline to the injector. It is also possible to integrally attach the damper mechanism to the high-pressure fuel pump, as embodied in the present invention.

What is claimed is:

1. A fluid pressure pulsation damper mechanism comprising:

a metal damper having two metal diaphragms joined together with a hermetic seal for forming a sealed spacing filled with a gas between the two metal diaphragms, an edge part of the metal damper formed by the metal diaphragms, which are overlapped along outer peripheries thereof;

a main body having a damper housing in which the metal damper is accommodated; and a cover attached to the main body to cover the damper housing and isolate the damper housing from outside air, the metal damper being held between the cover and the main body; wherein the cover further comprises a metal plate for making the cover, a peripheral edge of the cover being joined to the main body, the cover having a plurality of inner convex curved parts extending toward the main body, each inner convex curved part having a plurality of outer convex curved parts extending in different directions away from that inner convex curved part, the plurality of the inner convex curved parts being disposed circumferentially around the cover and inside the peripheral edge of the cover at which the cover is joined to the main body;

ends of the plurality of inner convex curved parts touch one side of the edge part of the metal damper, which edge part is outwardly formed in radial directions of a part including the sealed spacing in the metal damper;

the metal damper is held between the cover and a metal damper holding part of a holding member placed on the main body; and a spacing in the metal damper formed near the cover and another spacing in the metal damper formed near the main body communicate with each other through inside of the outer convex curved parts.

2. The fluid pressure pulsation damper mechanism according to claim 1, wherein the metal damper is discal and provided with a bulge having the sealed spacing formed therein;

ring-shaped flat parts are formed along a peripheral edge part of the metal damper;

outer peripheral edges of the peripheral edge part are joined by welding; and the ends of the inner convex curved parts on the cover touch one of the ring-shaped flat parts inwardly of the outer peripheral edges that are joined by welding.

3. The fluid pressure pulsation damper mechanism according to claim 2, wherein a flat part is formed on each of the ends of the inner convex curved parts, and the flat part touches the one of the ring-shaped flat parts.

4. The fluid pressure pulsation damper mechanism according to claim 1, wherein the metal damper holding part faces the main body and is formed by a holding member separately from the main body.

5. The fluid pressure pulsation damper mechanism according to claim 4, wherein the holding member is made of an elastic metal plate so that the holding member is elastically deformed when the metal damper is pressed by the plurality of inner convex curved parts toward the main body.

6. The fluid pressure pulsation damper mechanism according to claim 1, wherein the metal damper holding part is a protrusion extending toward the cover and is formed integrally with the main body.

7. The fluid pressure pulsation damper mechanism according to claim 1, wherein both of the metal diaphragms of the metal damper that is accommodated in the damper housing are exposed to a flow of fluid supplied to the damper housing and contract and expand in response to changes in dynamic pressure produced by pressure pulsation in the flow of fluid so as to eliminate effects of the pressure pulsation.

8. The fluid pressure pulsation damper mechanism according to claim 1, wherein the metal damper holding part has an opening that enables communication of a spacing formed between the metal damper holding part and the metal damper with another spacing formed between the cover and the metal damper holding part.

9. The fluid pressure pulsation damper mechanism according to claim 1, further comprising a fluid inlet for supplying fluid to the damper housing part and a fluid outlet for expelling fluid from the damper housing part.

10. A high-pressure fuel pump equipped with the fluid pressure pulsation damping mechanism described in claim 1, wherein the main body of the fluid pressure pulsation damping mechanism is structured as a body of the high-pressure fuel pump; the body is provided with a fuel inlet, a fuel outlet, a fuel pressurizing chamber formed therein, a cylinder fixed inside of the fuel pressurizing chamber and a plunger fitted into the cylinder so as to be slidable in a reciprocating fashion; fuel supplied from the fuel inlet is drawn by reciprocating the plunger in the fuel pressurizing chamber through an intake valve mechanism provided at an inlet on the fuel pressurizing chamber into the fuel pressurizing chamber, and then pressurized in the fuel pressurizing chamber, pressurized fuel being drawn from an expelling valve mechanism provided at an outlet of the fuel pressurizing chamber to the fuel outlet; and the damper housing part is disposed at an intermediate point of a fuel channel formed between the fuel inlet and the intake valve mechanism.

11. The high-pressure fuel pump equipped with the fluid pressure pulsation damping mechanism according to claim 10, wherein the damper housing part is provided with a first opening to communicate with the fuel inlet and a second opening to communicate with the intake valve mechanism.

12. The high-pressure fuel pump equipped with the fluid pressure pulsation damping mechanism according to claim 11, further comprising:

a seal attached to an outer periphery of the plunger at outside of the pressurizing chamber;

a seal holder for holding the seal to the outer peripheral surface of the plunger;

a fuel reservoir for collecting fuel leaking from an end of a sliding part between the plunger and the cylinder and disposed between the seal and the seal holder;

a fuel channel formed between the first opening in the damper housing part and the fuel inlet in the pump body; and a fuel return channel for communicating the fuel reservoir with the low-pressure fuel channel.

13. The high-pressure fuel pump equipped with the fluid pressure pulsation damping mechanism according to claim 12, wherein a diameter of a part on the plunger to which the seal is attached is smaller than a diameter of another part on the plunger over which the plunger fits to the cylinder.

14. The high-pressure fuel pump equipped the fluid pressure pulsation damping mechanism according to claim 12, wherein the first opening in the damper housing part is open to a wall facing the metal damper in the damper housing part;

the fuel channel disposed between the first opening and the fuel inlet in the pump body is formed as a first blind hole starting from the first opening and extending parallel to the plunger; and the fuel reservoir is connected to the blind hole through the fuel return.

15. The high-pressure fuel pump equipped with the fluid pressure pulsation damping mechanism according to claim 12, wherein the second opening in the damper housing part is open to a position other than the first opening in a wall facing the metal damper in the damper housing part; the fuel channel disposed between the second opening and the fuel inlet in the fuel pressurizing chamber is formed as a second blind hole starting from the second opening and extending parallel to the plunger; and a hole for attaching the intake valve mechanism to the pump body starts from an outer wall of the pump body, traverses the second blind hole, and extends to the fuel pressurizing chamber.

16. The high-pressure fuel pump equipped with the fluid pressure pulsation damping mechanism according to claim 10, wherein the damper housing part is an isolating wall, which is part of the fuel pressurizing chamber on the pump body, and isolates a wall facing the end surface of the plunger on the fuel pressurizing chamber side, and the damper housing part is formed on a outer wall of the pump body located outside the fuel pressurizing chamber;

the outer wall is provided with the first opening and the second opening; and the cover to cover the first opening and the second opening is fixed to the pump body.

17. The fluid pressure pulsation damper mechanism according to claim 1, wherein the cover is formed by pressing a thin steel plate.

18. The fluid pressure pulsation damper mechanism according to claim 1, wherein the cover is provided with a skirt on an outer peripheral part thereof;

a discal dent is formed on a covered part supported by the skirt;

the plurality of inner convex curved parts being inwardly recessed is disposed on a curved joint part between the discal dent and the skirt; and a curved surface between the inner convex curved parts constitutes one of the plurality of outer convex curved parts.

* * * * *